United States Patent [19]

Romano et al.

[11] Patent Number: 4,662,363

[45] Date of Patent: May 5, 1987

[54] ACCUPRESSURE PROBE POSITIONER

[76] Inventors: Peter A. Romano, 34-19 Broadway; Joseph Mileschuk, 34-12 29th St., both of Long Island City, N.Y. 11106

[21] Appl. No.: 871,779

[22] Filed: Jun. 9, 1986

Related U.S. Application Data

[63] Continuation of Ser. No. 668,470, Nov. 5, 1984, abandoned.

[51] Int. Cl.[4] ..... A61H 39/04

[52] U.S. Cl. ..... 128/60; 128/329 A

[58] Field of Search ..... 128/67, 54, 60, 61, 128/329 A, 303 R, 907

[56] References Cited

U.S. PATENT DOCUMENTS

| | | | |
|---|---|---|---|
| 787,168 | 4/1905 | Gibson | 128/67 |
| 1,868,452 | 7/1932 | Whitney | 128/60 |
| 3,403,674 | 10/1968 | Alimanestiano | 128/61 |
| 4,452,237 | 6/1984 | Lewis | 128/329 A X |
| 4,508,119 | 4/1985 | Tukamoto | 128/329 A |

FOREIGN PATENT DOCUMENTS

| | | | |
|---|---|---|---|
| 2610589 | 9/1977 | Fed. Rep. of Germany | 128/1.3 |
| 3202010 | 7/1983 | Fed. Rep. of Germany | 128/329 A |
| 3221544 | 12/1983 | Fed. Rep. of Germany | 128/1.3 |

*Primary Examiner*—Michael H. Thaler

*Attorney, Agent, or Firm*—Stoll, Wilkie, Previto & Hoffman

[57] ABSTRACT

An acupressure probe positioner having a frame assembly with a plurality of acupressure probes mounted therein. Each probe being adjustable vertically and horizontally to conform to the body contours of a patient.

17 Claims, 5 Drawing Figures

ACCUPRESSURE PROBE POSITIONER

This application is a continuation of pending U.S. application Ser. No. 668,470 filed Nov. 5, 1984, now abandoned.

DESCRIPTION

The present invention relates to an acupressure probe positioner and more particularly to an acupressure probe positioner that may be used to perform non-surgical treatment by means of acupressure, electronic acupressure, electronic stimulation, magnetic therapy and acupressure with magnetic therapy.

Acupressure is a treatment much like acupuncture but which uses finger pressure rather than needles. Present methods of acupressure limit the mobility of the doctor since he can only use one hand and one finger. This takes considerable time since the doctor must remain with the patient while applying finger pressure. In addition, present methods do not permit the doctor to use simultaneously the several types of acupressure outlined above.

The present invention avoids these difficulties and has for one of its objects the provision of a mechanism for applying acupressure by means of mechanical probes, as well as magnetic and electronic probes.

Another object of the present invention is the provision of a mechanism for applying acupressure whereby the doctor need not remain with the patient while the procedure is being performed.

Another object of the present invention is the provision of an improved mechanism for applying acupressure, whereby various parts of the body only need be treated at any one time.

Another object of the present invention is the provision of an improved mechanism for applying acupressure, whereby various parts of the body only need be treated at any one time.

Another object of the present invention is the provision of an improved mechanism for applying acupressure, whereby the amount of pressure applied may be easily regulated and held constant throughout the procedure.

Other and further objects of the invention will be obvious upon an understanding of the illustrative embodiment about to be described, or will be indicated in the appended claims, and various advantages not referred to herein will occur to one skilled in the art upon employment of the invention in practice.

The present invention accomplishes this by providing a vertically adjustable stand and probe frame assembly which is composed of a neck probe frame section, an upper body probe frame section, a lower body probe frame section and a leg support probe frame section. The probe frame assembly is secured to a movable vertically adjustable support stand which may be rotated to any angle.

As stated above, the probe frame assembly comes in several probe frame sections and the doctor may choose one or more of these sections as he requires. All the frame probe sections are provided with numerous pressure probe assemblies which are free to move in any direction as well as vertically and which are locked in position over the patient.

A preferred embodiment of the invention has been chosen for purposes of illustration and description and is shown in the accompanying drawings forming a part of the specification.

Figure 1:
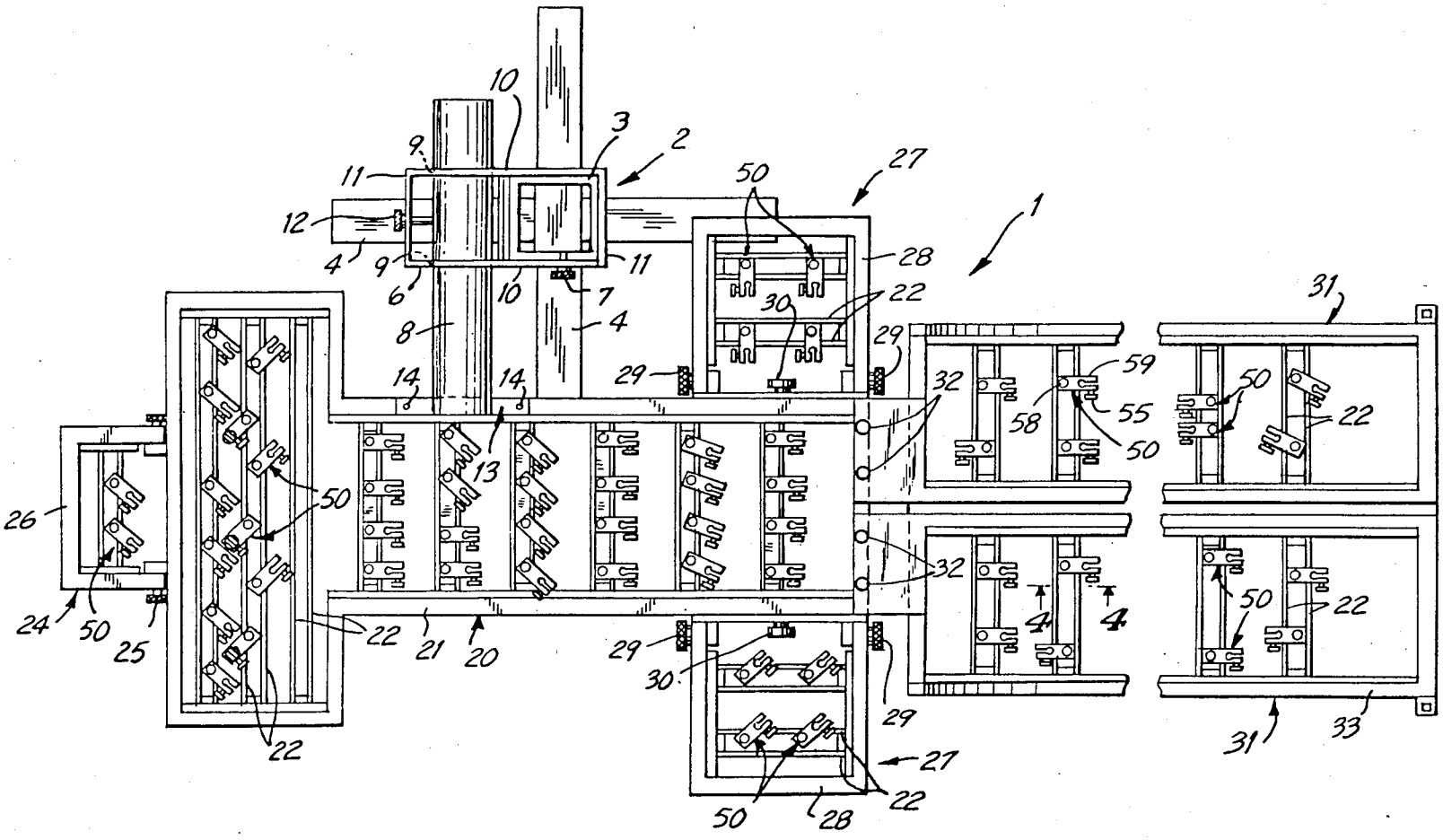
FIG. 1 is a plan view showing the acupressure probe positioner of the present invention.

Referring to the drawings and more particularly to FIG. 1, the probe positioner of the present invention comprises a probe frame assembly 1 mounted on a stand assembly 2. The stand assembly 2 comprises an upstanding hollow standard 3 mounted on a base 4 which is movable on wheels 5.

The hollow standard 3 is provided with an outer rectangular vertically adjustable sleeve 6, comprising parallel side walls 10 and parallel front and rear walls 11, which is adapted to be locked in place by a lock screw 7 extending through the side wall 10. A hollow tubular frame support member 8 extends horizontally through aligned openings 9 in the side walls 10 and is adjustable horizontally relative thereto and adapted to be locked in place by lock screw 12 in the rear wall 11. The probe frame assembly 1 is attached to the inner end of the tubular member 8 through an elongated U-shaped clamp 13 into which an edge of the probe frame assembly 1 is inserted and in which it is movable forwardly and rearwardly and locked in place by lock screws 14. It will thus be seen that the probe frame assembly 1 may be easily adjusted vertically and horizontally to any desired position.

The probe frame assembly 1 comprises an upper body probe frame section 20 which is substantially T-shaped and which has an outer frame 21 and a plurality of transverse rail pairs 22 bridging the outer frame 20. Attached to one end of the upper body probe frame section 20 is a neck probe frame section 24 which has an outer frame 26 and a plurality of transverse rail pairs 22 and which is pivotally mounted for angular movement relative to the upper body probe frame section 20 and adapted to be locked in place by lock screws 25.

Pivotally mounted to the other end of the upper body probe frame section 20 and extending at right angles thereto, are a pair of lower body probe frame sections 27, each of which has an outer frame 28 and a plurality of rail pairs 22 extending transversely thereacross. The lower body probe frame sections 27 are pivotally mounted for angular movement and adapted to be held at the desired angles by means of lock screws 29. Each lower body probe frame section 27 is removably and rotationaly mounted to the upper body probe frame section 20 by means of attaching screws 30.

Attached to the lower end of the upper body probe frame section 20 by screws 32 are a pair of leg probe frame sections 31. Each of the leg sections has an outer frame 33 having a plurality of transverse rail pairs 22. The leg probe frame sections 31 are peculiarly shaped as shown, to follow the contours of a patient when in a prone position.

Figures 2, 4:
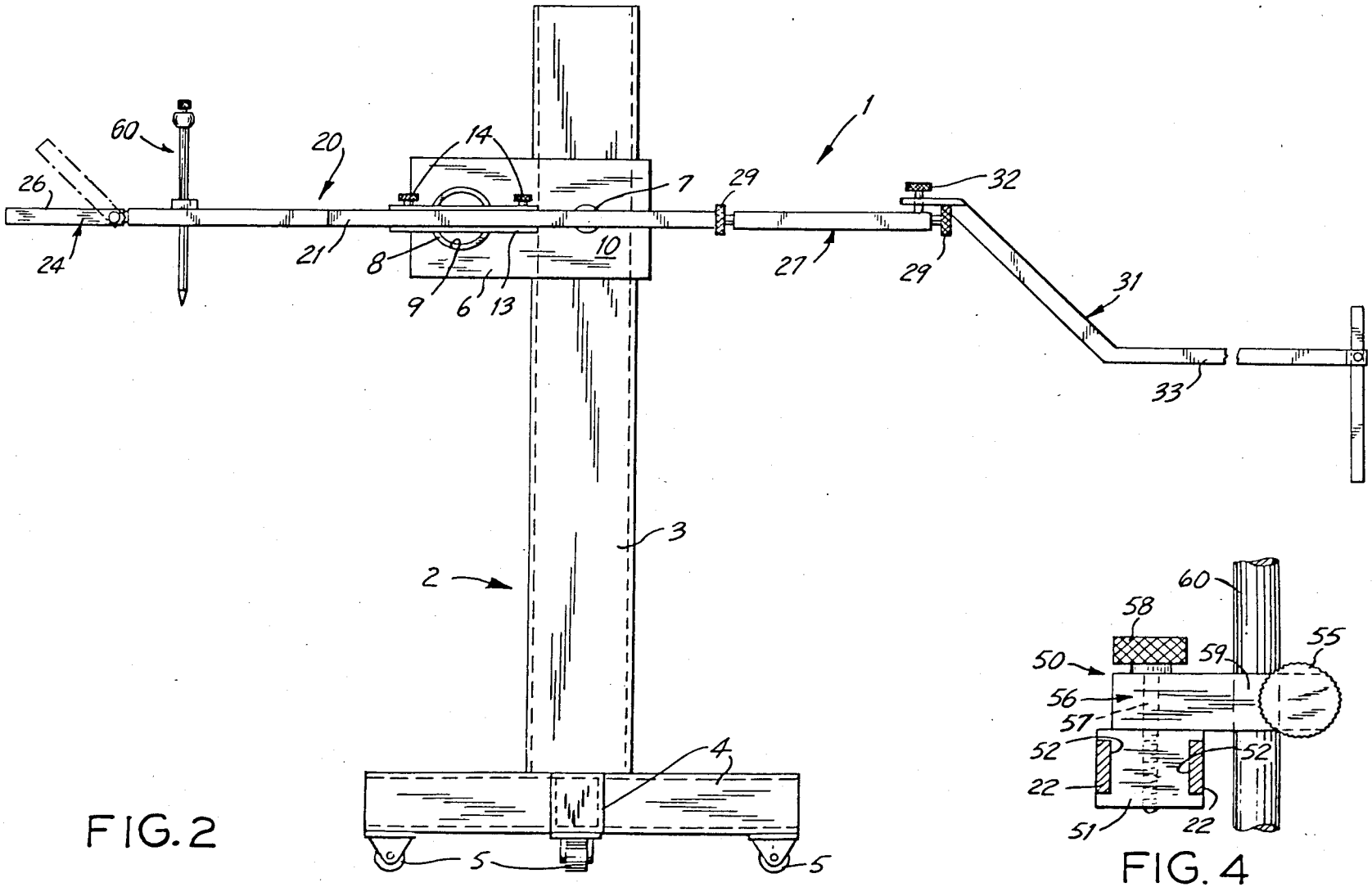
FIG. 2 is a side elevational view thereof.
FIG. 4 is a sectional view taken along line 4—4 of FIG. 1.
Figure 3:
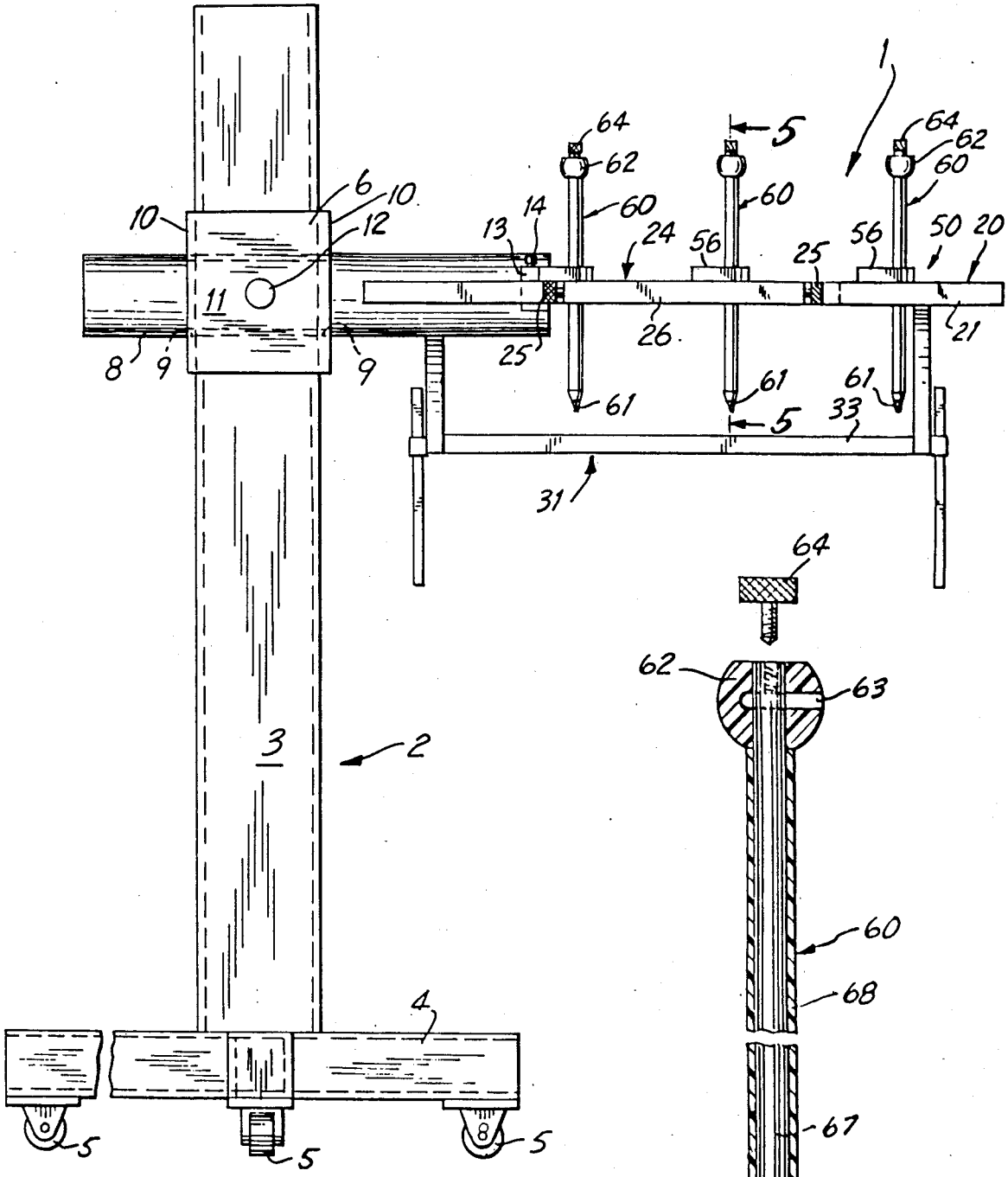
FIG. 3 is a rear view thereof.
Figure 5:
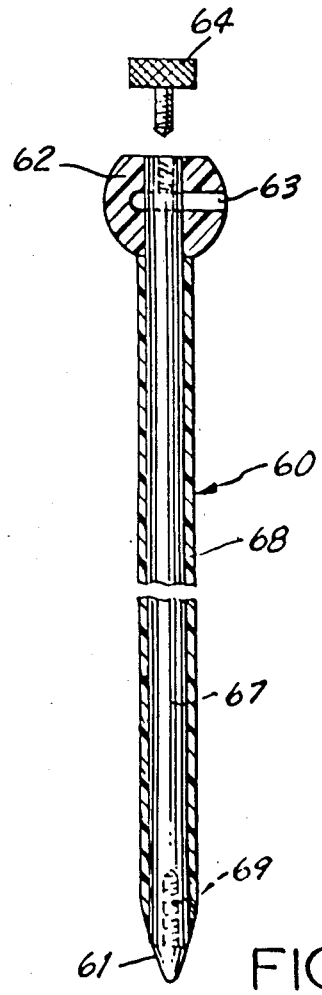
FIG. 5 is a sectional view taken along line 5—5 of FIG. 3.

Each of the probe frame sections 20, 24, 27 and 31 is provided with a plurality of vertically and pivotally mounted probe assemblies 50 mounted for movement on the transverse rails 22 through the intermediation of slide blocks 51 slidably mounted on the rails 22 by means of opposed notches 52, as will be seen in FIG. 4. Each slide block 51 has a probe clamp 56 mounted thereon for pivotal movement around body 57 of lock screw 58 which may be tightened by means of a lock screw 58 to lock the clamp 56 in the desired angular position. Each clamp 56 has an acupressure probe 60 mounted in its jaws 59 which is vertically adjustable therewithin. Each probe 60 is locked in place in the jaws 59 by lock screw 55 so that each probe 60 is individually adjusted vertically as well as horizontally in order to be placed in the proper position over a patient's body.

Each probe 60 comprises a steel rod 67 surrounded with insulation 68 and has a probe tip 61 removably attached thereto by means of screw thread 69. The upper end of the probe 60 is provided with insulated hand grip 62 with cavity 63 for the attachment of any electronic stimulating device (not shown) and which may be secured to the probe by means of an insulated locking screw 64. The probe pressure tip 61, shown in the drawings, is stainless steel. Its size and shape may vary depending on the type of pressure to be applied. If desired, magnetic tips (not shown) may be substituted for the stainless steel tip and may be attached to the bottom of the probe 60 by screw threads 69. Although the magnetic tips may be somewhat flattened, their size and shape may also vary.

When using the probe positioner for restoring normal function and balance to the human body by means of acupressure, the doctor positions the probe frame assembly 1 over the patient's body and based on the location of the treatment area he selects the particular probe frame assembly most suited for that area. For example, if he is treating the upper body area he does not need the leg probe frame sections and these may be removed. With the probe frame assembly 1 still over the patient's body the doctor selects the particular probe assemblies 60 nearest to the area to be treated. He then selects the correct size probe tip 61 and attaches it to the bottom of the probe 60. He adjusts the probe frame assembly 1 to within a couple of inches of the patient's body and he aligns the pressure probes 60 directly over the treatment area, unlocks the locking screw 55 of the probes 60 which he will be using and gently presses each probe 60 down until its tip 61 makes contact with the patient's body. When the doctor feels that each probe tip 61 is aligned correctly, he then bears down on the top of each pressure probe 60 to apply the necessary acupressure to the treatment area. He locks each probe 60 in place by tightening the lock screws 55 so that the doctor is free to walk away and leave the patient while the patient is undergoing acupressure. If desired, the doctor may select other treatment areas for different treatments at the same time, such as Electronic Stimulation.

It will be noted that the large number of probes disposed in the various probe frame sections permits each individual probe to be adjusted to the contours of the patient to give the patient the desired pressure at all the necessary pressure points. The present invention is particularly advantageous to doctors who specialize in Electronic Stimulation where the doctor has to hand hold the electronic probe to the treatment area. With the present invention, the doctor no longer has to hold the electronic probes manually. He simply attaches the electronic line contact to the pressure probes, locks the probes in its position and proceeds to other areas. Since this device offers numerous pressure probes, the doctor is no longer limited to one area of treatment.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. An acupressure probe positioner adapted to overlie a patient comprising a frame assembly oriented in a substantially horizontal plane, said frame assembly comprising a plurality of horizontal rail elements, a plurality of acupressure probes mounted on the rail elements of said probe assembly at an angle to said horizontal plane, each of said probes being individually adjustable vertically relative to said rail elements to a predetermined height, means for locking said probes at said predetermined height, means for adjusting the position of said probes horizontally along said rail elements, and said frame assembly being mounted on vertically and horizontally movable support means, whereby said probes may be individually positioned horizontally over the body areas of a patient who is being treated and individually moved downwardly relative to the frame assembly until the probes make contact with a patient's body and apply a predetermined amount of pressure on the patient's body at the point of contact of each probe with the patient's body.

2. A positioner as claimed in claim 1 wherein aid probe frame assembly comprises at least one probe frame section.

3. A positioner as claimed in claim 2 wherein a probe clamp is provided for holding said probe on said probe frame assembly.

4. A positioner as claimed in claim 3, wherein said probe clamp comprises jaws for holding said probe in place.

5. A positioner as claimed in claim 4 wherein locking means are provided to tighten the jaws around a probe.

6. A positioner as claimed in claim 5 wherein said clamp is slidably mounted on rails mounted on said probe frame assembly.

7. A positioner as claimed in claim 6 wherein means are provided to lock said probe clamp in place on said rail.

8. A positioner as claimed in claim 7 wherein said probe frame section has an outer frame and wherein said rails are transversely mounted on said outer frame.

9. A positioner as claimed in claim 8 wherein said probe frame assembly comprises an upper body section.

10. A positioner as claimed in claim 9 wherein a neck section is mounted on said upper body section for pivotal movement relative thereto.

11. A positioner as claimed in claim 10 wherein at least one lower body section is mounted on said upper body section for pivotal movement relative thereto.

12. A positioner as claimed in claim 11 wherein the lower body section is removably mounted on said upper body section.

13. A positioner as claimed in claim 12 wherein at least one leg section is removably mounted on the said upper body section.

14. A positioner as claimed in claim 13 wherein said probe has a removable tip at its lower end.

15. A positioner as claimed in claim 14 wherein said probe comprises an elongated metal rod surrounded by insulating material.

16. A positioner as claimed in claim 14 wherein said probe has means for attaching an electrical stimulating device at its upper end.

17. A positioner as claimed in claim 14 wherein said tip is a magnetic tip.

* * * * *